US007937001B2

(12) United States Patent
Eom

(10) Patent No.: US 7,937,001 B2
(45) Date of Patent: May 3, 2011

(54) DEVICE AND METHOD FOR DETECTING POSITION OF UNIT MOUNTED IN IMAGE FORMING APPARATUS

(75) Inventor: Yoon-Seop Eom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 874 days.

(21) Appl. No.: 11/360,465

(22) Filed: Feb. 24, 2006

(65) Prior Publication Data

US 2006/0233557 A1 Oct. 19, 2006

(30) Foreign Application Priority Data

Apr. 18, 2005 (KR) ..... 10-2005-0031929

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS

| | | | | |
|---|---|---|---|---|
| 7,177,551 | B2 * | 2/2007 | Eom et al. | 399/12 |
| 2003/0133719 | A1 * | 7/2003 | Tsuruya et al. | 399/12 |

FOREIGN PATENT DOCUMENTS

| | | | |
|---|---|---|---|
| EP | 0395320 | A1 | 10/1990 |
| EP | 1176478 | A1 | 1/2002 |
| JP | 2001-296786 | | 10/2001 |
| JP | 2002-040904 | | 2/2002 |
| JP | 2002169428 | | 6/2002 |
| JP | 2004-136507 | | 5/2004 |
| KR | 2003-0027838 | | 4/2003 |

* cited by examiner

*Primary Examiner* — David M Gray
*Assistant Examiner* — Erika Villaluna
(74) *Attorney, Agent, or Firm* — Roylance, Abrams, Berdo & Goodman, LLP

(57) ABSTRACT

A device and a method for detecting the position of a developing unit mounted in an image forming apparatus are provided. The device includes an image forming controller outputting a clock signal for accessing first to Nth (N is a positive integer greater than 1) developing units, a switching unit performing a switching operation for connecting the image forming controller to a Kth (K is a positive integer greater than 1 and equal to or smaller than N) mounting slot in order to transmit the clock signal to the Kth mounting slot among first to Nth mounting slots in which the first to Nth developing units are mounted, respectively, first to Nth clock signal lines connecting the switching unit to the first to Nth mounting slots, and a data line commonly connecting the image forming controller to the first to Nth mounting slots, wherein the switching unit performs the switching operation in accordance with a switching signal for connecting the image forming controller to the Kth mounting slot and the image forming controller determines whether the Kth developing unit is mounted on the Kth mounting slot in response to reception of an access signal from the Kth mounting slot.

17 Claims, 3 Drawing Sheets

DEVICE AND METHOD FOR DETECTING POSITION OF UNIT MOUNTED IN IMAGE FORMING APPARATUS

CROSS-REFERENCE TO RELATED APPLICATION

This application claims the benefit under 35 U.S.C. §119 (a) of a Korean patent application No. 10-2005-0031929, filed on Apr. 18, 2005, in the Korean Intellectual Property Office, the entire disclosure of which is hereby incorporated by reference.

BACKGROUND OF THE INVENTION

1. Field of the Invention

The present invention relates to image forming apparatus. More particularly, the present invention relates to a device and method for detecting whether a developing unit is mounted in the right position in an image forming apparatus.

2. Description of the Related Art

In general, a color image forming apparatus comprises color developing units respectively storing yellow toner, magenta toner, black toner, and cyan toner and having a non-volatile memory. The color image forming apparatus is generally controlled by an inter integrated circuit (I2C) scheme that allows a data signal line and a clock signal line to be shared by many elements.

Conventionally, in order to allow an image forming controller to control the developing unit and determine the consumed amount of toner in the developing unit, the image forming controller and the developing units share two lines which are a data signal line and a clock signal line.

However, by sharing these two lines, when the developing unit is not mounted in the right position in the color image forming apparatus, a user may not be aware of this and unwanted sheets may be printed.

SUMMARY OF THE INVENTION

An object of the present invention is to provide a device for detecting the position of a developing unit mounted in an image forming apparatus.

Another object of the present invention is also to provide a method of detecting the position of identifying a developing unit mounted in an image forming apparatus.

According to an aspect of the present invention, a device for detecting the position of a developing unit mounted in an image forming apparatus is provided. The device comprises an image forming controller for outputting a clock signal for accessing first to Nth (N is a positive integer greater than 1) developing units, a switching unit for performing a switching operation for connecting the image forming controller to a Kth (K is a positive integer greater than 1 and equal to or smaller than N) mounting slot in order to transmit the clock signal to the Kth mounting slot among first to Nth mounting slots in which the first to Nth developing units are mounted, respectively, first to Nth clock signal lines for connecting the switching unit to the first to Nth mounting slots, and a data line for commonly connecting the image forming controller to the first to Nth mounting slots, wherein the switching unit performs the switching operation in accordance with a switching signal for connecting the image forming controller to the Kth mounting slot and the image forming controller determines whether the Kth developing unit is mounted on the Kth mounting slot in response to an access signal received from the Kth mounting slot.

According to another aspect of the present invention, a method of detecting the position of a developing unit mounted in an image forming apparatus is provided. The method comprises outputting a switching signal for connecting a Kth (K is a positive integer larger than 1 and smaller than or equal to N) mounting slot among first to Nth mounting slots in which first to Nth (N is a positive integer larger than 1) developing units are mounted, respectively, to an image forming controller, connecting the image forming controller to the Kth mounting slot in accordance with the switching signal, outputting clock signals for accessing the first to Nth developing units from the image forming controller to the Kth mounting slot, outputting data including Kth identification information for identifying the Kth developing unit among identification information on the first to Nth developing units for identifying the first to Nth developing units to the Kth mounting slot, sensing whether an access signal from the Kth mounting slot is received, and recognizing that the Kth developing unit is mounted in the Kth mounting slot in response to the access signal received from the Kth mounting slot.

BRIEF DESCRIPTION OF THE DRAWINGS

The above and other features and advantages of the present invention will become more apparent by describing in detail exemplary embodiments thereof with reference to the attached drawings in which.

The same reference numerals are used to represent the same elements throughout the drawings.

DETAILED DESCRIPTION OF EXEMPALRY EMBODIMENTS

Hereinafter, a device for detecting the position of a developing unit mounted in an image forming apparatus according to the present invention will be described in detail with reference to the accompanying drawings.

Figure 1:
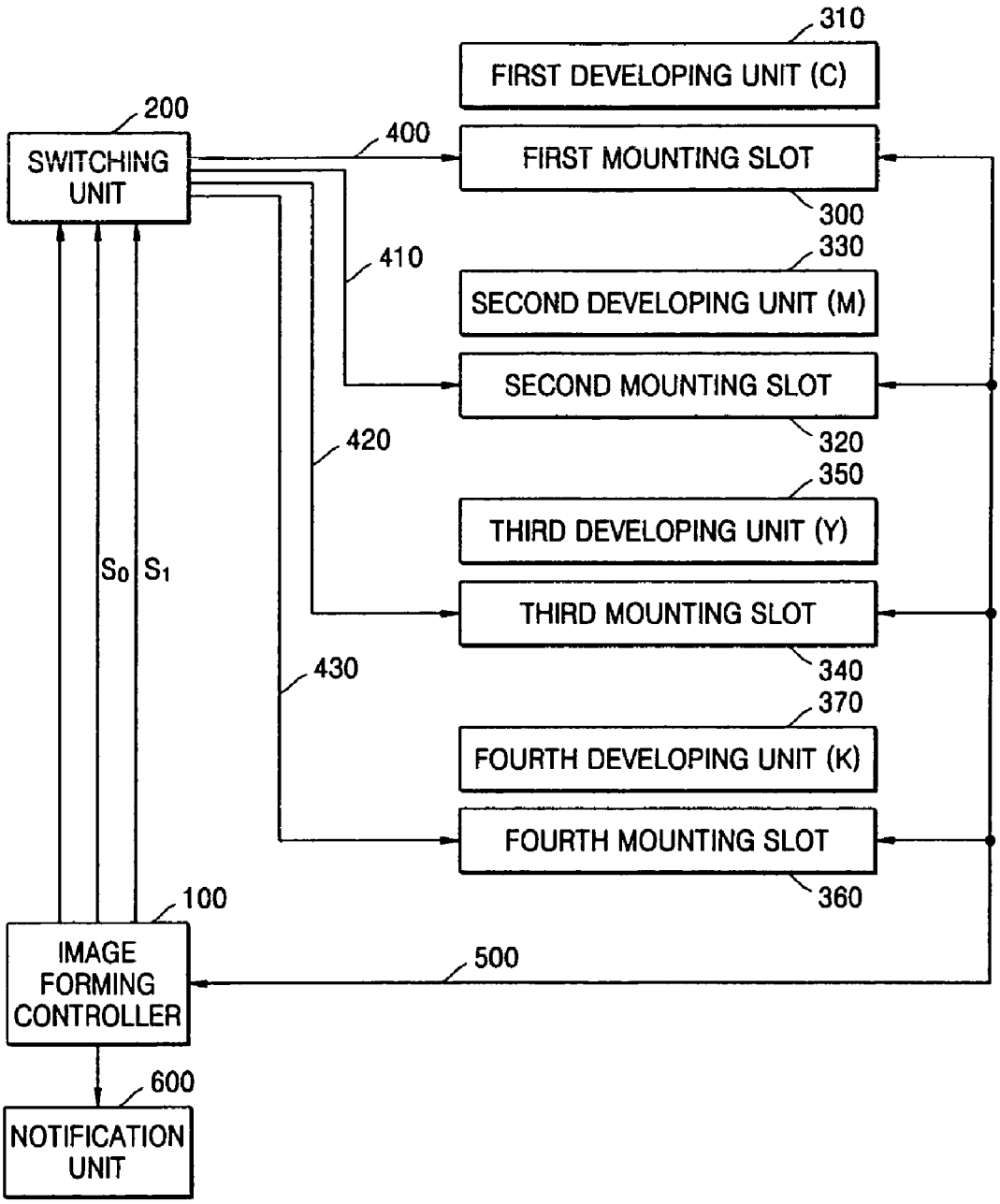
FIG. 1 is a block diagram illustrating a device for detecting the position of a developing unit mounted in an image forming apparatus according to an exemplary embodiment of the present invention.

FIG. 1 is a block diagram illustrating a device for detecting the position a developing unit mounted in an image forming apparatus according to an exemplary embodiment of the present invention. The device comprises an image forming controller 100, a switching unit 200, a first mounting slot 300, a first developing unit 310, a second mounting slot 320, a second developing unit 330, a third mounting slot 340, a third developing unit 350, a fourth mounting slot 360, a fourth developing unit 370, a first clock signal line 400, a second clock signal line 410, a third clock signal line 420, a fourth clock line signal 430, a data line 500, and a notification unit 600.

The image forming controller 100 outputs clock signals for accessing the first through fourth developing units 310, 330, 350, and 370 to the switching unit 200. The clock signal is a signal for synchronous communication generated by the image forming controller 100 and output to the switching unit 200.

Further, the image forming controller 100 transmits to the switching unit 200 a switching signal for connection between the image forming controller 100 and a specific mounting slot among the first through the fourth mounting slots 300, 320, 340, and 360. One example of the switching signal is shown in Table 1.

TABLE 1

| switching signal | |
|---|---|
| S0 | S1 |
| 0 | 0 |
| 0 | 1 |
| 1 | 0 |
| 1 | 1 |

The switching signal is a 2-bit signal to identify the first to the fourth mounting slots 300, 320, 340, and 360. For example, the switching signal "00" is output when the image forming controller 100 has to be connected to the first mounting slot 300, the switching signal "01" is output when the image forming controller 100 has to be connected to the second mounting slot 320, the switching signal "10" is output when the image forming controller 100 has to be connected to the third mounting slot 340, and the switching signal "11" is output when the image forming controller 100 has to be connected to the fourth mounting slot 360.

In order to transmit a clock signal to any one of the first to the fourth mounting slots 300, 320, 340, and 360 for mounting the first to the fourth developing units 310, 330, 350, and 370, the switching unit 200 performs a switching operation for connecting the image forming controller 100 to one of the mounting slots 300 through 360 according to the switching signal received from the image forming controller 100.

For example, if the switching signal "00" is received, the switching unit 200 performs a switching operation so that the first clock signal line 400 which is connected to the first mounting slot 300 is connected to the image forming controller 100. Therefore, by a switching operation of the switching unit 200, the clock signal of the image forming controller 100 can be transmitted to the first mounting slot 300 through the first clock signal line 400.

Further, if the switching signal "01" is received, the switching unit 200 performs a switching operation so that the second clock signal line 410 which is connected to the second mounting slot 320 is connected to the image forming controller 100. Therefore, by a switching operation of the switching unit 200, the clock signal of the image forming controller 100 can be transmitted to the second mounting slot 320 through the second clock signal line 410.

Further, if the switching signal "10" is received, the switching unit 200 performs a switching operation so that the third clock signal line 420 which is connected to the third mounting slot 340 is connected to the image forming controller 100. Therefore, by a switching operation of the switching unit 200, the clock signal of the image forming controller 100 can be transmitted to the first mounting slot 340 through the first clock signal line 420.

Further, if the switching signal "11" is received, the switching unit 200 performs a switching operation so that the fourth clock signal 430 which is connected to the fourth mounting slot 360 is connected to the image forming controller 100. Therefore, by a switching operation of the switching unit 200, the clock signal of the image forming controller 100 can be transmitted to the fourth mounting slot 360 through the fourth clock signal line 430.

The first through the fourth clock signal lines 400, 410, 420, and 430 respectively connect the switching unit 200 to the first through fourth mounting slots 300, 320, 340, and 360. As described above, the first through fourth clock signal lines 400, 410, 420, and 430 act as channels through which the clock signals are respectively transmitted to the first through the fourth mounting slots 300, 320, 340, and 360.

The data line 500 connects the image forming controller 100 to the first through the fourth mounting slots 300, 320, 340, and 360. Therefore, data are exchanged between the image forming controller 100 and the first through the fourth mounting slots 300, 320, 340, and 360 through the data line 500.

When the image forming controller 100 receives an access signal from any one of the first to the fourth mounting slots 300, 320, 340, and 360, it recognizes that any one developing unit of the first to the fourth developing units 310, 330, 350, and 370 is respectively mounted in any one mounting slot of the first to the fourth mounting slots 300, 320, 340, and 360.

That is, the image forming controller 100 outputs through the data line 500 data including any one of identification information among identification information on the first through the fourth developing unit to the mounting slot which has received the clock signal. The image forming controller 100 adds the address information on the developing unit as identification information on the developing unit to data.

Figure 2:
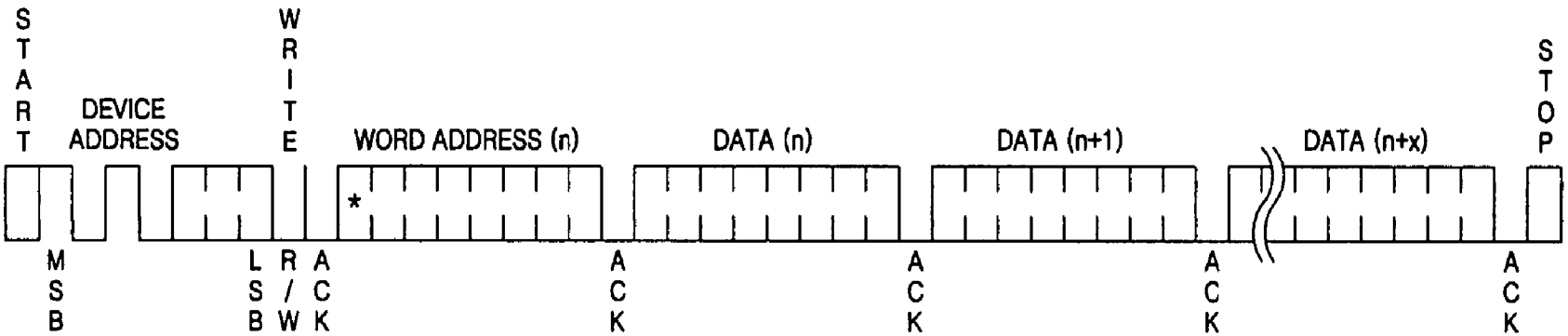
FIG. 2 is a diagram illustrating data to which an identification information of a developing unit is added according to an exemplary embodiment of the present invention.

FIG. 2 is a diagram illustrating data to which identification information of a developing unit is added according to an exemplary embodiment of the present invention. As shown in FIG. 2, it is confirmed that a device address as the identification information of the developing unit is added to the data.

For example, if a mounting slot for receiving the clock signal is the second mounting slot 320, the second developing unit 330 should be mounted in the second mounting slot 320. The image forming controller 100 outputs data to which the identification information of the second developing unit 330 corresponding to the identification information of the second developing unit 330 is added to the second mounting slot 320. If an access signal from the second mounting slot 320 is received, the image forming controller 100 recognizes that the second developing unit 330 is mounted in the second mounting slot 320.

However, if the access signal from the second mounting slot 320 is not received, the image forming controller 100 adds any one identification information among other identification information (identification information of the first developing unit, the third developing unit, and the fourth developing unit) except the identification information of the second developing unit to data and outputs the data to the second mounting slot 320. When the data to which the identification information of the first developing unit is added are output to the second mounting slot 320, if the access signal from the second mounting slot 320 is received, the image forming controller 100 recognizes that the first developing unit 310 is wrongly mounted in the second mounting slot 320. Because the first developing unit 310 that should be mounted in the first mounting slot 300 is mounted in the second mounting slot 320, the mounting is wrong. When the data to which the identification information of the first developing unit is added are output to the second mounting slot 320, if the access signal from the second mounting slot 320 is not received, the image forming controller 100 outputs data to which the identification information of the third developing unit and the fourth developing unit is added in the order to the second mounting slot 320. If the access signal from the second mounting slot 320 is not received, the image forming controller 100 detects that no developing unit is mounted in the second mounting slot 320.

The notification unit 600 notifies a user of the detection result of the image forming controller 100. For example, if a mounting slot receiving the clock signal is the second mounting slot 320, according to the detection result that the second developing unit 330 is mounted in the second mounting slot 320, the notification unit 600 notifies a user that the second developing unit 330 is rightly mounted in the second mounting slot 320. Further, according to the detection result that any one among the first developing unit 310, the third developing unit 350 or the fourth developing unit 370 is mounted in the second mounting slot 320, the notification unit 600 notifies a user that other developing unit except the second developing unit 330 is wrongly mounted in the second mounting slot 320.

Further, according to the detection result that no developing unit is mounted in the second mounting slot 320, the notification unit 600 notifies a user that no developing unit is mounted in the second mounting slot 320.

According to an exemplary implementation of the present invention, a device for detecting the position a developing unit mounted in an image forming apparatus comprises the first to the fourth developing units 310, 330, 350, and 370, but the clock signal lines are added or subtracted depending on addition or subtraction of the developing units.

Hereinafter, a method of detecting the position of a developing unit mounted in an image forming apparatus according to an exemplary embodiment of the present invention will be described in detail with reference to the accompanying drawings.

Figure 3:
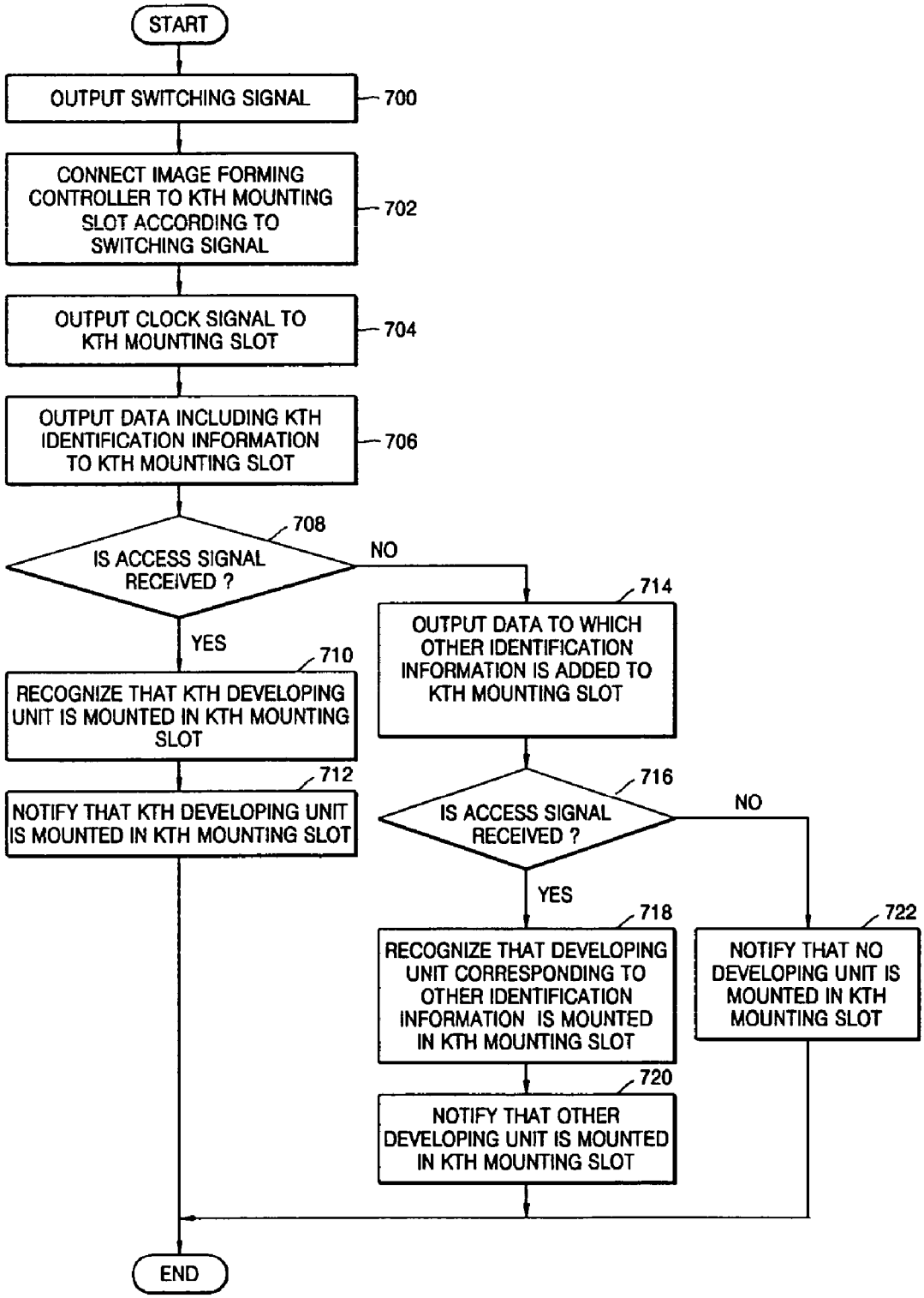
FIG. 3 is a flow chart illustrating a method of detecting the position of a developing unit mounted in an image forming apparatus according to an exemplary embodiment of the present invention.

FIG. 3 is a flow chart illustrating a method of detecting the position of a developing unit mounted in an image forming apparatus according to an exemplary embodiment of the present invention.

First, a switching signal for connecting a Kth (K is a positive integer larger than 1 and smaller than N) mounting slot among first to Nth mounting slots in which respective first to Nth (N is a positive integer larger than 1) developing units are mounted to an image forming controller is output at step 700. An example of the switching signal is illustrated in Table 1. As illustrated in Table 1, the number of bits of the switching signal is dependent on the number of the developing units.

After step 700, according to the switching signal, the image forming controller is connected to the Kth mounting slot at step 702.

After operation 702, a clock signal for accessing the first to Nth developing units is output from the image forming controller to Kth mounting slot at step 704.

After step 704, data including Kth identification information for identifying the Kth developing unit among the identification information of the first to Nth developing units for identifying the first to Nth developing units are output to the Kth mounting slot at step 706. At this time, the address information of the Kth developing unit to which data is added is output to the Kth mounting slot as the Kth identification information.

After step 706, it is sensed whether an access signal from the Kth mounting slot is received at step 708.

After step 708, if the access signal from the Kth mounting slot is received, it is determined that the Kth developing unit is mounted in the Kth mounting slot at step 710.

After step 710, a notification unit notifies a user that the Kth developing unit is mounted in the Kth mounting slot at step 712.

On the other hand, at step 706, if the access signal from Kth mounting slot is not received, data to which other identification information except the Kth identification information is added are output to the Kth mounting slot at step 714.

After step 714, it is sensed whether the access signal from the Kth mounting slot is received at step 716.

After step 716, if the access signal from the Kth mounting slot is received, it is determined that the developing unit corresponding to other identification information is mounted in the Kth mounting slot at step 718.

After step 718, the notification unit notifies a user that the developing unit corresponding to other identification information is mounted in the Kth mounting slot at step 720.

On the other hand, at step 716, if the access signal from Kth mounting slot is not received, the notification unit notifies a user that no developing unit is mounted in the Kth mounting slot at step 722.

The exemplary embodiments of the present invention can be written as computer readable codes/instructions/programs and can be implemented in general-use digital computers that execute the programs using a computer readable recording medium. Examples of the computer readable recording medium comprise magnetic storage media, such as ROM, floppy disks, hard disks, magnetic tapes, and the like, optical recording media, such as CD-ROMs, DVDs and the like, and storage media such as carrier waves, such as transmission through the Internet. Further, the computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

The device and method of the present invention sense that color developing units of an image forming apparatus are not mounted in a designated position and notify a user of this fact.

Further, the device and method of the present invention prevent unwanted sheets from being printed because the color developing units are not mounted in the right position.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus for printing color images comprising:

an image forming controller for accessing first to Nth (N is a positive integer greater than 1) developing units;

first to Nth mounting slots to receive the first to Nth developing units, the first to Nth mounting slots including a first mounting slot non-movably installed in the image forming apparatus to receive the first developing unit at a first mounting location, a second mounting slot non-movably installed in the image forming apparatus to receive the second developing unit at a second mounting location, a third mounting slot non-movably installed in the image forming apparatus to receive the third developing unit at a third mounting location and a fourth mounting slot non-movably installed in the image forming apparatus to receive the fourth developing unit at a fourth mounting location;

a switching unit coupled between the image forming controller and the mounting slots for performing a switching operation in accordance with a switching signal;

first to Nth clock signal lines for delivering clock signals from the switching unit to the first to Nth mounting slots, the first to Nth clock signal lines including a first clock signal line coupled between the switching unit and the first mounting slot, a second clock signal line coupled between the switching unit and the second mounting slot, a third clock signal line coupled between the switching unit and the third mounting slot, and a fourth clock signal line coupled between the switching unit and the fourth mounting slot; and a data line for connecting the image forming controller to the first to Nth mounting slots;

wherein the switching unit performs the switching operation in accordance with switching signal such that one of the clock signals is transmitted to one of the mounting slots corresponding to the switching signal without transmitting the respective clock signal to the remaining mounting slots; and wherein the image forming controller determines whether a developing unit associated with a proper color is mounted on one of the mounting slots corresponding to the switching signal based on a signal received from one of the mountings via the data line.

2. The image forming apparatus according to claim 1, wherein the switching signal is output by the image forming controller to the switching unit.

3. The image forming apparatus according to claim 1, wherein the image forming controller outputs data including Kth identification information (K is a positive integer greater than 1 and equal to or smaller than N) for identifying the Kth developing unit among identification information on the first to Nth developing units for identifying the first to Nth developing units to the Kth mounting slot through the data line in accordance with the clock signal.

4. The image forming apparatus according to claim 3, wherein the image forming controller adds other identification information except the Kth identification information to the data and outputs the data to the Kth mounting slot when the access signal from the Kth mounting slot is not received after the data are outputted.

5. The image forming apparatus according to claim 3, wherein the image forming controller adds the address information of the Kth developing unit as the Kth identification information to the data and outputs the data to the Kth mounting slot.

6. The image forming apparatus according to claim 1, further comprising a notification unit for notifying a user of the detection result of the image forming controller.

7. The image forming apparatus according to claim 1, wherein the notification unit displays an error message that the Kth developing unit is not mounted in the Kth mounting slot in accordance with the detection result that the Kth developing unit is not mounted in the Kth mounting slot.

8. The image forming apparatus according to claim 1, wherein the notification unit displays the information on the developing unit mounted in the Kth mounting slot in accordance with the recognized result that the Kth developing unit is not mounted in the Kth mounting slot.

9. A method of detecting the position of a developing unit mounted in an image forming apparatus, the method comprising:

outputting a switching signal for connecting a Kth (K is a positive integer larger than 1 and smaller than or equal to N) mounting slot among first to Nth mounting slots in which first to Nth (N is a positive integer larger than 1) developing units are mounted, respectively, to an image forming controller;

connecting the image forming controller to the Kth mounting slot in accordance with the switching signal;

outputting clock signals for accessing the first to Nth developing units from the image forming controller to the Kth mounting slot;

outputting data including Kth identification information for identifying the Kth developing unit among identification information on the first to Nth developing units for identifying the first to Nth developing units to the Kth mounting slot;

sensing whether an access signal from the Kth mounting slot is received; and recognizing that the Kth developing unit is mounted in the Kth mounting slot in response to the access signal received from the Kth mounting slot.

10. The method according to claim 9, wherein the outputting comprises adding address information on the Kth developing unit as the Kth identification information to the data and outputting the data to the Kth mounting slot.

11. The method according to claim 9, further comprising notifying a user that the Kth developing unit is mounted in the Kth mounting slot.

12. The method according to claim 9, further comprising:

adding other identification information except the Kth identification information to the data and outputting the data to the Kth mounting slot if the access signal from the Kth mounting slot is not received;

sensing whether the access signal from the Kth mounting slot is received; and detecting that the developing unit corresponding to the other identification information is mounted in the Kth mounting slot if the access signal from the Kth mounting slot is received.

13. The method according to claim 12, further comprising notifying a user that the developing unit corresponding to the other identification information is mounted in the Kth mounting slot after the detecting.

14. The method according to claim 12, further comprising notifying a user that the developing unit is not mounted in the Kth mounting slot if the access signal from the Kth mounting slot is not received during the sensing.

15. A program code embodied on a computer-readable medium comprising:

a first set of instructions for outputting a switching signal for connecting a Kth (K is a positive integer larger than 1 and smaller than or equal to N) mounting slot among first to Nth mounting slots in which first to Nth (N is a positive integer larger than 1) developing units are mounted, respectively, to an image forming controller;

a second set of instructions for connecting the image forming controller to the Kth mounting slot in accordance with the switching signal;

a third set of instructions for outputting clock signals for accessing the first to Nth developing units from the image forming controller to the Kth mounting slot;

a fourth set of instructions for outputting data including Kth identification information for identifying the Kth developing unit among identification information on the first to Nth developing units for identifying the first to Nth developing units to the Kth mounting slot;

a fifth set of instructions for sensing whether an access signal from the Kth mounting slot is received; and a sixth set of instructions for recognizing that the Kth developing unit is mounted in the Kth mounting slot in response to the access signal received from the Kth mounting slot.

16. The program code as claimed in claim 15, wherein said first set of instructions further comprises a set of instructions for adding address information on the Kth developing unit as the Kth identification information to the data and outputting the data to the Kth mounting slot.

17. The program code as claimed in claim 15, further comprising a set of instructions for notifying a user that the Kth developing unit is mounted in the Kth mounting slot.

* * * * *